US011119447B2

(12) United States Patent
Balmer et al.

(10) Patent No.: US 11,119,447 B2
(45) Date of Patent: Sep. 14, 2021

(54) TIMEPIECE COMPRISING AN ELECTRIC MOTOR FIXED TO A MOUNTING PLATE

(71) Applicant: ETA SA Manufacture Horlogere Suisse, Grenchen (CH)

(72) Inventors: Raphael Balmer, Vicques (CH); Pascal Lagorgette, Bienne (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 408 days.

(21) Appl. No.: 16/162,928

(22) Filed: Oct. 17, 2018

(65) Prior Publication Data

US 2019/0179267 A1 Jun. 13, 2019

(30) Foreign Application Priority Data

Dec. 8, 2017 (EP) ..... 17206185

(51) Int. Cl.
*G04C 3/00* (2006.01)
*G04C 3/14* (2006.01)
*G04C 10/02* (2006.01)

(52) U.S. Cl.
CPC ..... *G04C 3/008* (2013.01); *G04C 3/14* (2013.01); *G04C 10/02* (2013.01)

(58) Field of Classification Search
CPC ..... G04C 3/008; G04C 10/02; G04C 3/00
See application file for complete search history.

(56) References Cited

U.S. PATENT DOCUMENTS

| | | | | |
|---|---|---|---|---|
| 4,426,159 | A * | 1/1984 | Kosaka | G04C 13/11 368/80 |
| 6,751,164 | B1 * | 6/2004 | Sekiguchi | G04C 3/146 368/21 |
| 6,791,905 | B1 * | 9/2004 | Sekiguchi | G04G 9/0082 368/80 |
| 2003/0123328 | A1 * | 7/2003 | Guanter | G04G 11/00 368/82 |
| 2007/0053241 | A1 | 3/2007 | Meister et al. | |
| 2017/0176945 | A1 * | 6/2017 | Lagorgette | G04C 3/00 |
| 2018/0011447 | A1 * | 1/2018 | Yoshizumi | G04B 47/00 |

FOREIGN PATENT DOCUMENTS

| | | |
|---|---|---|
| DE | 10 2014 205 385 A1 | 9/2015 |
| EP | 1 760 557 A1 | 3/2007 |
| FR | 2 666 665 A1 | 3/1992 |

OTHER PUBLICATIONS

European Search Report dated Jun. 18, 2018 in European Application 17206185.5 filed Dec. 8, 2017 (with English Translation of Categories of Cited Documents).

* cited by examiner

*Primary Examiner* — Sean Kayes
(74) *Attorney, Agent, or Firm* — Oblon, McClelland, Maier & Neustadt, L.L.P.

(57) ABSTRACT

A timepiece including a case middle closed by a glass and the following elements positioned in the case middle: a dial, a rigid mounting plate extending under the dial, a module including an electric motor, referred to as the motor module, a printed circuit board, of which at least a first portion is interposed between the mounting plate and the motor module, means for the assembly of the motor module on the mounting plate through the first portion of the printed circuit board.

8 Claims, 2 Drawing Sheets

TIMEPIECE COMPRISING AN ELECTRIC MOTOR FIXED TO A MOUNTING PLATE

CROSS-REFERENCE TO RELATED APPLICATION

This application claims priority to European Patent Application No. 17206185.5 filed on Dec. 8, 2017 the entire disclosure of which is incorporated herein by reference.

FIELD OF THE INVENTION

The invention relates to the field of quartz watches with an analogue display. This type of watch has as its regulating means a quartz oscillator vibrating under the effect of the electrical energy provided by a battery and which, in association with an electronic circuit, actuates a stepping motor causing display hands to rotate.

BACKGROUND TO THE INVENTION

Patent Application EP 1 760 557 A1, describing a quartz watch with an analogue display, is already familiar. The timepiece includes a case enclosing in particular hands, a dial made of a semiconductor material and extending beneath the hands, a printed circuit board disposed beneath the dial, and a driving device mounted on the lower face of the printed circuit board. The driving device includes a horological electric motor and means of transmission enabling the required demultiplication to be obtained for driving each hand. The printed circuit board is rigid and rests on edges of the case. In addition, a printed circuit board element is engraved in the dial, said printed circuit board element comprising contact pads connected electrically to conductive tracks of the printed circuit board.

This device exhibits a number of disadvantages. A first disadvantage is that the printed circuit board must be rigid, whereas flexible printed circuits exhibit numerous advantages in comparison with rigid printed circuits: saving in space and weight, ease of integration, improved resistance to difficult conditions and vibrations. A second disadvantage is that the dial is electrically connected to the printed circuit board, which complicates the manufacture and the assembly of the timepiece. A third disadvantage is that the number of electronic components that it is possible to mount on the printed circuit board (for example antennas, sensors, integrated circuits, etc.) is small: they can be mounted only on the lower surface of the printed circuit board.

SUMMARY OF THE INVENTION

The aim of the present invention is to address at least one of the aforementioned disadvantages.

For this purpose, the invention relates to a timepiece comprising a case middle closed by a glass and the following elements positioned in the case middle:

- a dial
- a rigid mounting plate extending under the dial
- a module comprising an electric motor, referred to as the motor module
- a printed circuit board, of which at least a first portion is interposed between the mounting plate and the motor module
- means for the assembly of the motor module on the mounting plate through the first portion of the printed circuit board.

In one embodiment, the dial is intended to be positioned under a glass of the timepiece in such a way as to be visible by a wearer. In another embodiment, this dial is covered by at least another layer, for example an assembly consisting of a solar cell, the assembly being retained on the dial by means of a double-sided adhesive. The dial would then not be visible, or would be only partially visible, through the glass. The upper layer, which is visible through the glass, could then carry the indices.

According to the invention, the motor module is not fixed directly to the dial, as in the aforementioned prior art document, and therefore the dial does not need to be formed from a particular type of material, to have a particular structure or even to be connected to electrical contact pads.

According to a non-restrictive embodiment, the printed circuit board comprises a second portion disposed against the motor module, such that the motor module is interposed between the first portion and the second portion, the printed circuit board further comprising a lateral tab connecting the first portion and the second portion.

It is thus possible to mount a large number of electronic components on the printed circuit board, since components may be fixed to the first portion and to the second portion, on one or other of their faces according to what is technically possible.

According to a non-restrictive embodiment, the printed circuit board is flexible. Alternatively, the printed circuit board is rigid on the majority of its surface, and it includes at least one flexible part (forming the tab) allowing at least one of its parts to be folded onto the lower part of the motor module in order to form the second part.

The utilisation of a flexible printed circuit board is possible because the motor module is supported by means of the rigid mounting plate. It should be noted that the flexible printed circuit boards include numerous advantages, already mentioned above, in comparison with their rigid equivalents.

According to one embodiment, the timepiece comprises a spacer, of which one part is disposed laterally to either side of the motor module and is sandwiched between the first portion and the second portion of the printed circuit board.

The surfaces of the first portion and of the second portion of the printed circuit board may thus be larger than the upper surface and the lower surface of the motor module, the portions of the printed circuit board which are not in contact with the motor module then resting on the spacer.

The spacer is made advantageously of plastic, for cost considerations. The spacer is formed advantageously in one piece.

According to one embodiment, the timepiece comprises an electric battery installed in a housing for another part of the plastic spacer.

BRIEF DESCRIPTION OF THE DRAWINGS

Other features and advantages will be appreciated clearly from the following description thereof, which are provided for information purposes and are in no way restrictive, with reference to the accompanying drawings, in which.

DETAILED DESCRIPTION OF THE PREFERRED MODES OF IMPLEMENTATION

Figure 1:
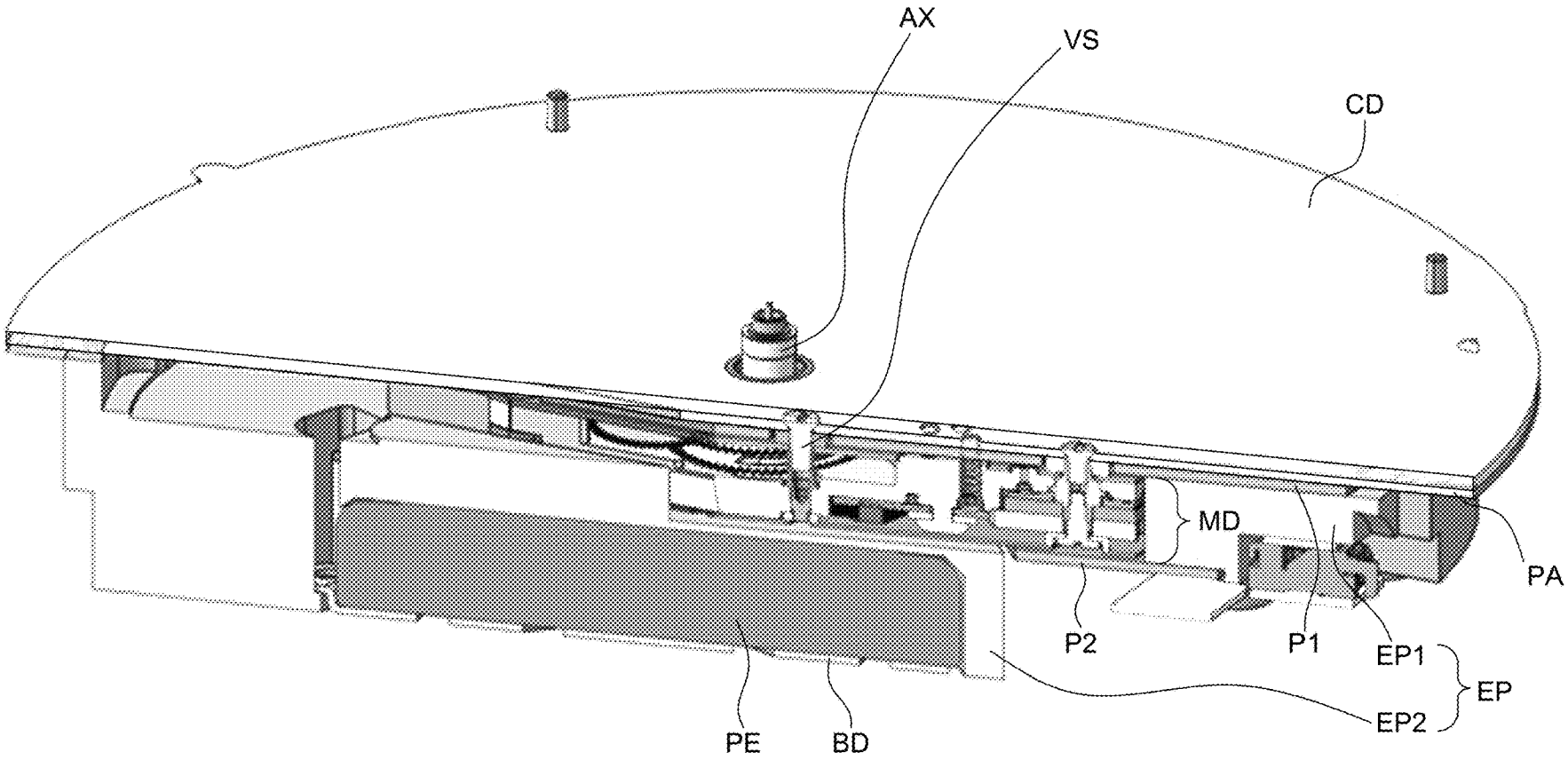
FIGS. 1 and 2 illustrate different views of a part of a timepiece according to the invention.
Figure 2:
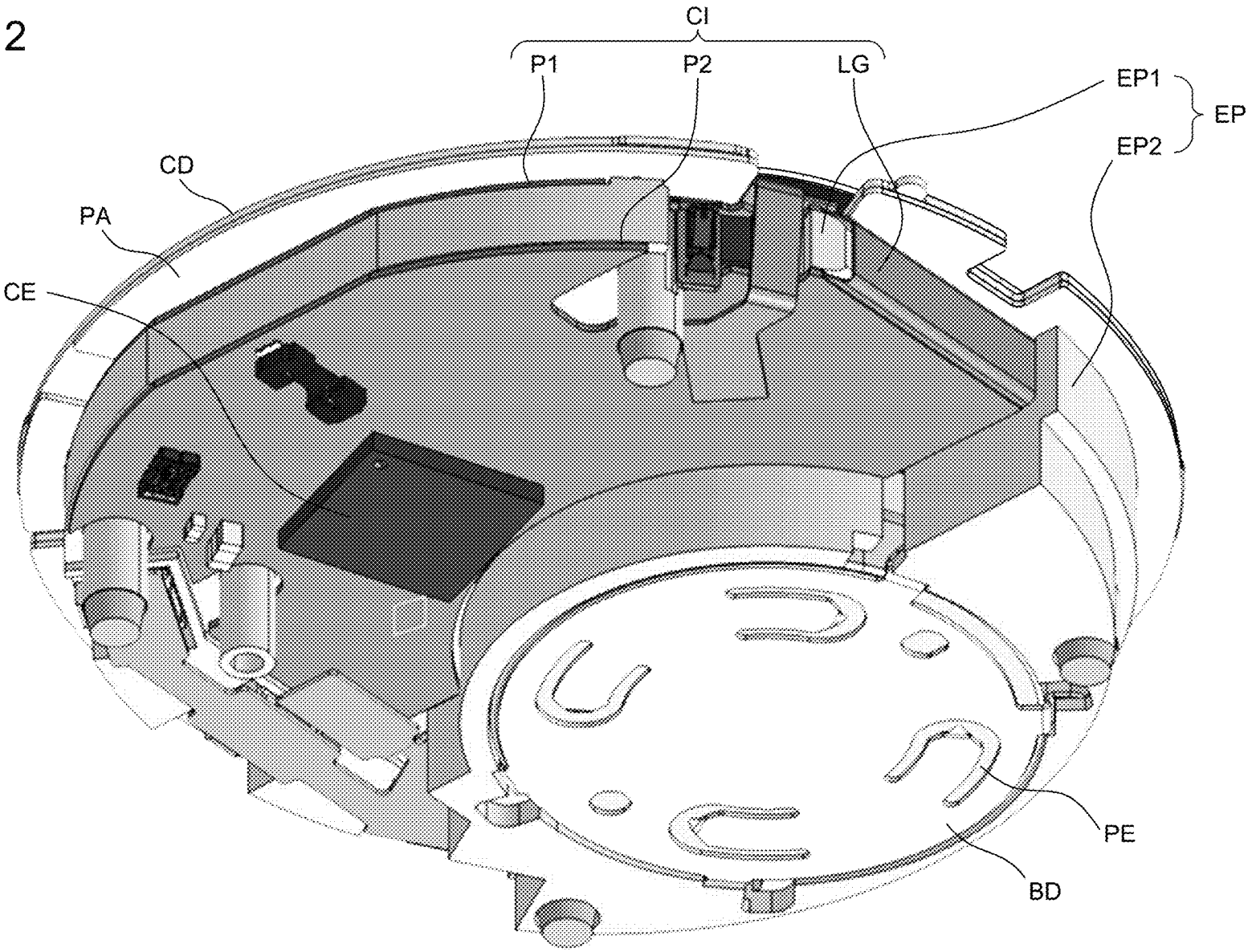

With reference to FIGS. 1 and 2, a timepiece according to the invention comprises, among others:

A dial CD, of which an upper surface includes a peripheral zone exhibiting indices (not illustrated here). The dial CD is intended to be positioned under a glass of the timepiece in such a way as to be visible by a wearer. In another embodiment, this dial CD could be covered by at least another layer, for example an assembly consisting of a solar cell or a digital display, the assembly being capable of being retained on the dial by means of a double-sided adhesive. The dial CD would then not be visible, or would be only partially visible, through the glass. The upper layer (that is to say the layer on the side of the watch glass; the expression lower referring, on the contrary, to the side of the case back of the watch), could then carry the indices.

A rigid mounting plate PA, located beneath the dial CD. In the non-restrictive embodiment depicted here, the dimensions of the mounting plate PA are substantially identical to the dimensions of the dial CD, such that these two layers overlap one another almost perfectly. The mounting plate is metallic, for example.

A module comprising an electric motor, referred to as the motor module MD. Said motor is intended, among other things, to cause the display hands (not illustrated here) of the timepiece to rotate about an axis AX.

A printed circuit board CI (in English "printed circuit board", abbreviated to PCB). In the described non-restrictive embodiment, the printed circuit board CI is flexible, at least in part, and comprises three portions:

A first portion P1 interposed between the mounting plate PA and the motor module MD. An upper surface of the motor module MD is disposed against the first portion P1, and an upper surface of the first portion P1 is disposed against the mounting plate PA. In addition, the motor module MD, the first portion P1 of the printed circuit board and the mounting plate PA are securely joined together.

A second portion P2 disposed against the motor module MD, such that the motor module MD is interposed between and is retained against the first portion P1 and the second portion P2.

A lateral tab LG connecting the first portion P1 and the second portion P2.

A plurality of electronic components CE fixed to the lower face of the first portion P1 of the printed circuit board CI, and to the upper face and the lower face of the second portion P2 of the printed circuit board CI. The components CE are, for example, antennas, sensors, integrated circuits, etc. It should be noted that the use of a folded printed circuit board CI allows a large surface to be available for positioning the electronic components CE.

A spacer EP, made of plastic in a single piece in the non-restrictive embodiment described here, of which a first part EP1 is located laterally to either side of the motor module MD and is sandwiched between the first portion P1 and the second portion P2 of the printed circuit board CI. A second part EP2 of the spacer EP comprises a housing to accommodate an electric battery or an accumulator.

An electric battery PE (or an accumulator) housed in the housing of the second part EP2 of the spacer EP and enabling the electric motor MD and the plurality of electronic components CE to be powered.

It should be noted that the axis AX passes orthogonally through the first portion P1 of the printed circuit board CI, the mounting plate PA, as well as the dial CD. The display hands of the timepiece are intended to rotate above the dial CD and about the axis AX.

Furthermore, as mentioned previously, the motor module MD, the first portion P1 of the printed circuit board CI and the mounting plate PA are assembled via fixing means, which comprise screws VS, for example.

The present invention is not restricted to the illustrated example, of course, but lends itself to different variants and modifications which will be familiar to a person skilled in the art.

The invention claimed is:

1. A timepiece, comprising:

a case middle closed by a glass, the case middle including:

a dial, a rigid mounting plate extending under the dial, a motor module comprising an electric motor, a printed circuit board, wherein at least a first portion of the printed circuit board is interposed between the mounting plate and the motor module, and means for securing the first portion of the printed circuit board and the motor module onto the mounting plate through a hole in the first portion of the printed circuit board.

2. The timepiece according to claim 1, wherein the printed circuit board comprises a second portion disposed against the motor module, such that the motor module is interposed between the first portion and the second portion of the printed circuit board, the printed circuit board further comprising a lateral tab connecting the first portion and the second portion.

3. The timepiece according to claim 2, further comprising a spacer, wherein a first part of the spacer is disposed laterally to either side of the motor module and is sandwiched between the first portion and the second portion of the printed circuit board.

4. The timepiece according to claim 3, wherein the spacer is made of plastic.

5. The timepiece according to claim 3, further comprising an electric battery installed in a housing of a second part of the spacer.

6. The timepiece according to claim 1, wherein the printed circuit board is flexible.

7. The timepiece of claim 1, wherein the means for securing is a screw that passes through the mounting plate and passes through the first portion of the printed circuit board.

8. The timepiece of claim 1, wherein the means for securing directly contacts the first portion of the printed circuit board, the mourning plate, and the motor module.

* * * * *